US010765935B2

(12) United States Patent
Lee et al.

(10) Patent No.: US 10,765,935 B2
(45) Date of Patent: Sep. 8, 2020

(54) TILE DISPENSERS AND METHODS OF DISPENSING TILES

(71) Applicant: Mattel, Inc., El Segundo, CA (US)

(72) Inventors: Tai To Lee, Kowloon (HK); Jin Qi Qin, Guangxi (CN); Damon R. Saddler, Inglewood, CA (US)

(73) Assignee: Mattel, Inc., El Segundo, CA (US)

( * ) Notice: Subject to any disclaimer, the term of this patent is extended or adjusted under 35 U.S.C. 154(b) by 669 days.

(21) Appl. No.: 14/482,419

(22) Filed: Sep. 10, 2014

(65) Prior Publication Data

US 2015/0069701 A1 Mar. 12, 2015

Related U.S. Application Data

(60) Provisional application No. 61/876,204, filed on Sep. 10, 2013.

(51) Int. Cl.

| | |
|---|---|
| ***A63F 11/00*** | (2006.01) |
| ***A63F 3/00*** | (2006.01) |
| *A63F 3/04* | (2006.01) |

(52) U.S. Cl.

CPC ..... *A63F 11/0002* (2013.01); *A63F 3/00895* (2013.01); *A63F 3/0423* (2013.01)

(58) Field of Classification Search

CPC ..... A63F 1/12; A63F 1/14
USPC ..... 273/149 R
See application file for complete search history.

(56) References Cited

U.S. PATENT DOCUMENTS

| | | | | | |
|---|---|---|---|---|---|
| 1,229,558 | A | * | 6/1917 | Webster | G07F 17/14 194/250 |
| 1,651,605 | A | * | 12/1927 | Kuhn | G07F 11/44 194/297 |
| 1,859,635 | A | * | 5/1932 | Rose | G07F 11/16 194/261 |
| 1,929,788 | A | | 10/1933 | Arrowsmith | |
| 1,981,581 | A | * | 11/1934 | Burn | 273/144 A |
| 2,003,979 | A | * | 6/1935 | Skoric | G07C 15/001 273/144 A |
| 2,256,340 | A | * | 9/1941 | Gora et al. | 446/298 |
| 2,349,623 | A | | 5/1944 | Hickey | |
| 2,490,144 | A | * | 12/1949 | Masten | 273/144 A |

(Continued)

FOREIGN PATENT DOCUMENTS

GB 2 460 758 12/2009

*Primary Examiner* — John E Simms, Jr.
*Assistant Examiner* — Dolores R Collins
(74) *Attorney, Agent, or Firm* — Edell, Shapiro & Finnan, LLC

(57) ABSTRACT

A tile dispenser includes a tile chamber in which tiles are shuffleable and a gate element. The gate element is moveable between a closed position in which the gate element is loadable with one or more tiles coming from the tile chamber and an open position for dispensing any tiles that have been loaded into the gate element. A method of using the tile dispenser includes placing a plurality of tiles into the tile chamber in which the plurality of tiles are shuffleable and loading a predetermined number of the plurality of tiles into the gate element when the gate element is in the closed position. A method of manufacturing the tile dispenser includes providing the tile chamber, and providing the gate element in a location such that the gate element is loadable with one or more tiles coming from the tile chamber when in the closed position.

20 Claims, 11 Drawing Sheets

(56) References Cited

U.S. PATENT DOCUMENTS 2,539,216 A * 1/1951 Weinschenk ..... A47F 1/03 221/200
2,731,268 A * 1/1956 Raizen ..... 273/144 A
2,893,735 A * 7/1959 Tranter, Jr. ..... 273/144 A
2,979,230 A * 4/1961 Calverley ..... 221/186
3,189,221 A 6/1965 Lachance
3,232,621 A * 2/1966 Michelson ..... 273/144 R
3,353,883 A * 11/1967 Cairo ..... A45D 8/185 206/818
3,757,994 A * 9/1973 Skoetsch ..... A47F 1/10 221/202
3,831,743 A * 8/1974 Leedy ..... B65D 83/02 206/338
3,845,958 A 11/1974 Reinertsen
3,856,312 A 12/1974 Dabrowski
3,953,027 A 4/1976 Katzman et al.
4,004,811 A 1/1977 Brandin
4,111,429 A 9/1978 Waski
4,205,465 A 6/1980 Mannarino
4,309,035 A * 1/1982 Goldfarb ..... A63F 11/0002 273/144 R
4,732,387 A * 3/1988 Elinski ..... G07C 15/003 273/144 A
4,877,246 A * 10/1989 Kropkowski ..... 273/144 R
5,125,659 A 6/1992 Garbee
5,312,103 A * 5/1994 Chateau ..... A63F 7/048 273/144 A
5,366,110 A 11/1994 Takemoto et al.
5,941,420 A * 8/1999 Connan ..... B65D 81/3283 222/145.3
6,595,385 B2 * 7/2003 Nakamoto ..... A63H 33/00 221/24
6,899,148 B1 * 5/2005 Geltser ..... B65B 5/103 141/104
7,988,152 B2 * 8/2011 Sines
D661,144 S * 6/2012 Rothschild ..... D6/515
8,967,621 B2 * 3/2015 Sines et al. ..... 273/149 R
2003/0230848 A1 12/2003 Mellerowicz
2005/0179204 A1 * 8/2005 Curtis ..... A63F 3/0423 273/272
2012/0252545 A1 * 10/2012 Osborne et al. ..... 463/9

* cited by examiner

TILE DISPENSERS AND METHODS OF DISPENSING TILES

CROSS-REFERENCE TO RELATED PATENT APPLICATIONS

This application claims priority from U.S. Provisional Patent App. No. 61/876,204, filed Sep. 10, 2013, the entire contents of which are incorporated by reference herein.

FIELD

Embodiments described herein generally relate to dispensers for mixing and dispensing game tiles, and particularly to dispensers that are configured to dispense one or more tiles at a time.

BACKGROUND

Tile-based games, such as the SCRABBLE® crossword game, and other tile-based activities require a plurality of tiles for game play. Traditionally, game tiles in the SCRABBLE® crossword game and other similar tile-based games are hand-selected by each player. For such hand selection, the tiles may typically be stored in a box, bag, or other type of container. A player may then select individual tiles or grab a handful of tiles depending on the number of tiles needed or allowed for game play.

SUMMARY OF THE DISCLOSURE

A tile dispenser in accordance with an embodiment includes a tile chamber in which tiles are shuffleable, and a gate element. The gate element is moveable between a closed position in which the gate element is loadable with one or more tiles coming from the tile chamber and an open position for dispensing any tiles that have been loaded into the gate element. In some embodiments, the tile dispenser further includes a push member positioned to interact with the gate element and moveable from a first position to a second position to cause the gate element to move from the closed position to the open position.

A method of using the tile dispenser in accordance with an embodiment includes placing a plurality of tiles into the tile chamber in which the plurality of tiles are shuffleable, and loading a predetermined number of the plurality of tiles into the gate element of the tile dispenser when the gate element is in the closed position. In some embodiments, the method further includes shaking the tile dispenser to shuffle the plurality of tiles in the tile chamber. Also, in some embodiments, the method further includes moving the push member to cause the gate element to move to the open position to dispense any tiles that have been loaded into the gate element.

A method of manufacturing the tile dispenser in accordance with an embodiment includes providing the tile chamber with a shape in which tiles are shuffleable and providing the gate element in a location such that the gate element is loadable with one or more tiles coming from the tile chamber when in the closed position. In various embodiments, the method further includes providing the push member in a location to interact with the gate element such that a movement of the push member from the first position to the second position causes the gate element to move from the closed position to the open position.

DETAILED DESCRIPTION

Embodiments of tile dispensers as well as methods of manufacturing and using tile dispensers are disclosed herein. Embodiments of a tile dispenser may be configured to allow for placement of a plurality of tiles therein, for a randomized shuffling by a mixing of the tiles, and for dispensing one or more such tiles from the tile dispenser by a triggering event. The triggering event may be user initiated, such as by a push-action by a user, or the like, or may be automated. In some embodiments, tile dispensers disclosed herein may be configured to dispense a plurality of tiles at a time when a user activates or otherwise triggers a push-type mechanism. In various embodiments, the number of tiles being dispensed is predetermined and pre-set by a manufacturer of the tile dispenser. In some embodiments, the number of tiles to be dispensed is selectable by a user.

In some embodiments, a tile dispenser is configured to facilitate both placing the desired number of tiles to be dispensed in a loaded position within a section of the tile dispenser and dispensing the loaded tiles therefrom in response to a trigger, such as a push-action operation, and/or the like, by a user. In addition, in various embodiments the tile dispenser is configured to allow for mixing of tiles within one or more tile chambers or holding areas in the tile dispenser. In various embodiments, the tiles may be shuffled by movement of the tiles in the tile dispenser before any of them are dispensed. In further or other embodiments, the tiles may be shuffled by mixing when a user engages a push-action mechanism. In various embodiments, some tiles may be dispensed when a gate element of the tile dispenser is opened in response to a push-action on a push-action mechanism by a user, or when the user disengages the push-action mechanism.

Various embodiments will be described in detail with reference to the accompanying drawings. Wherever possible, the same reference numbers are used throughout the drawings to refer to the same parts.

Figure 1:
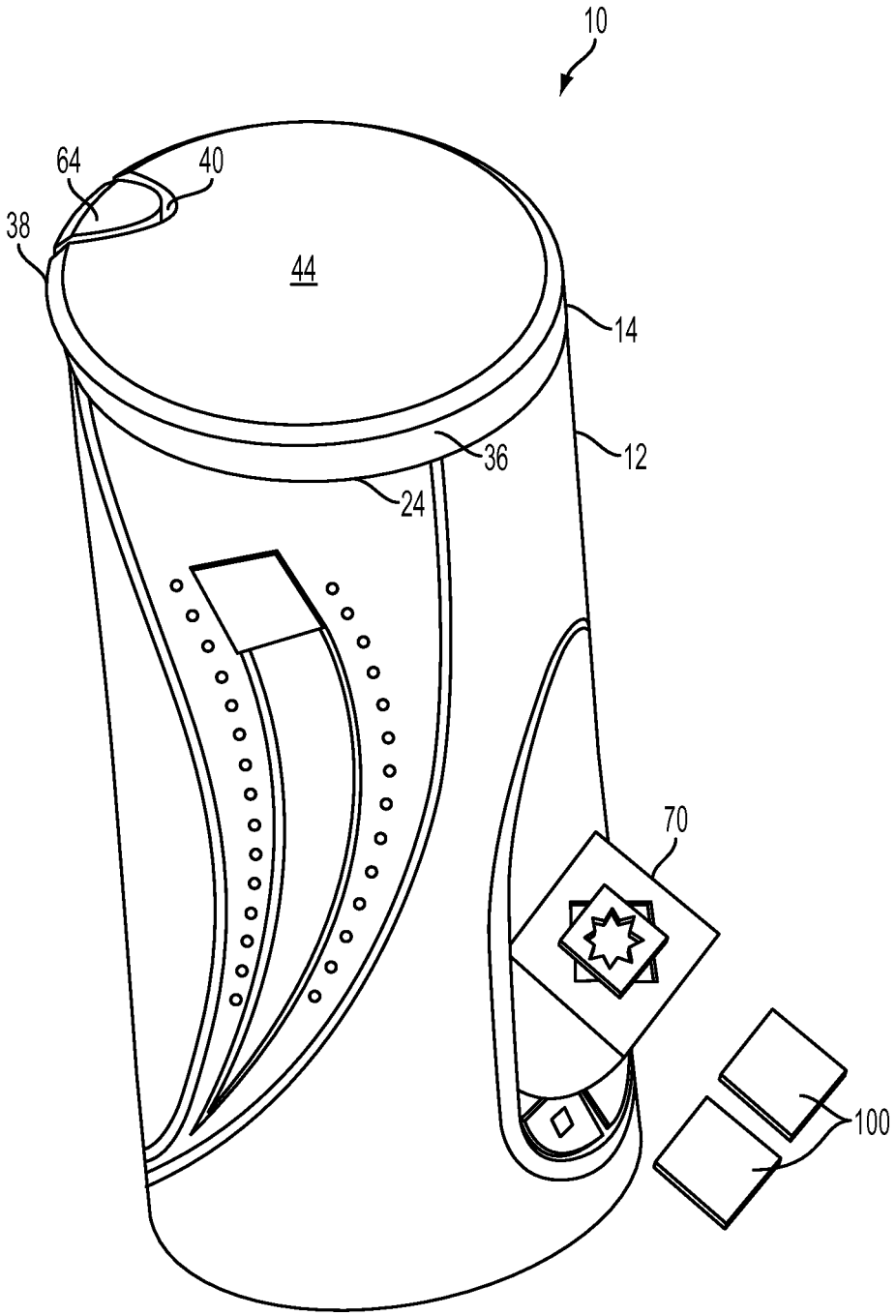
FIG. 1 is a perspective view of a tile dispenser according to various embodiments.
Figure 7:
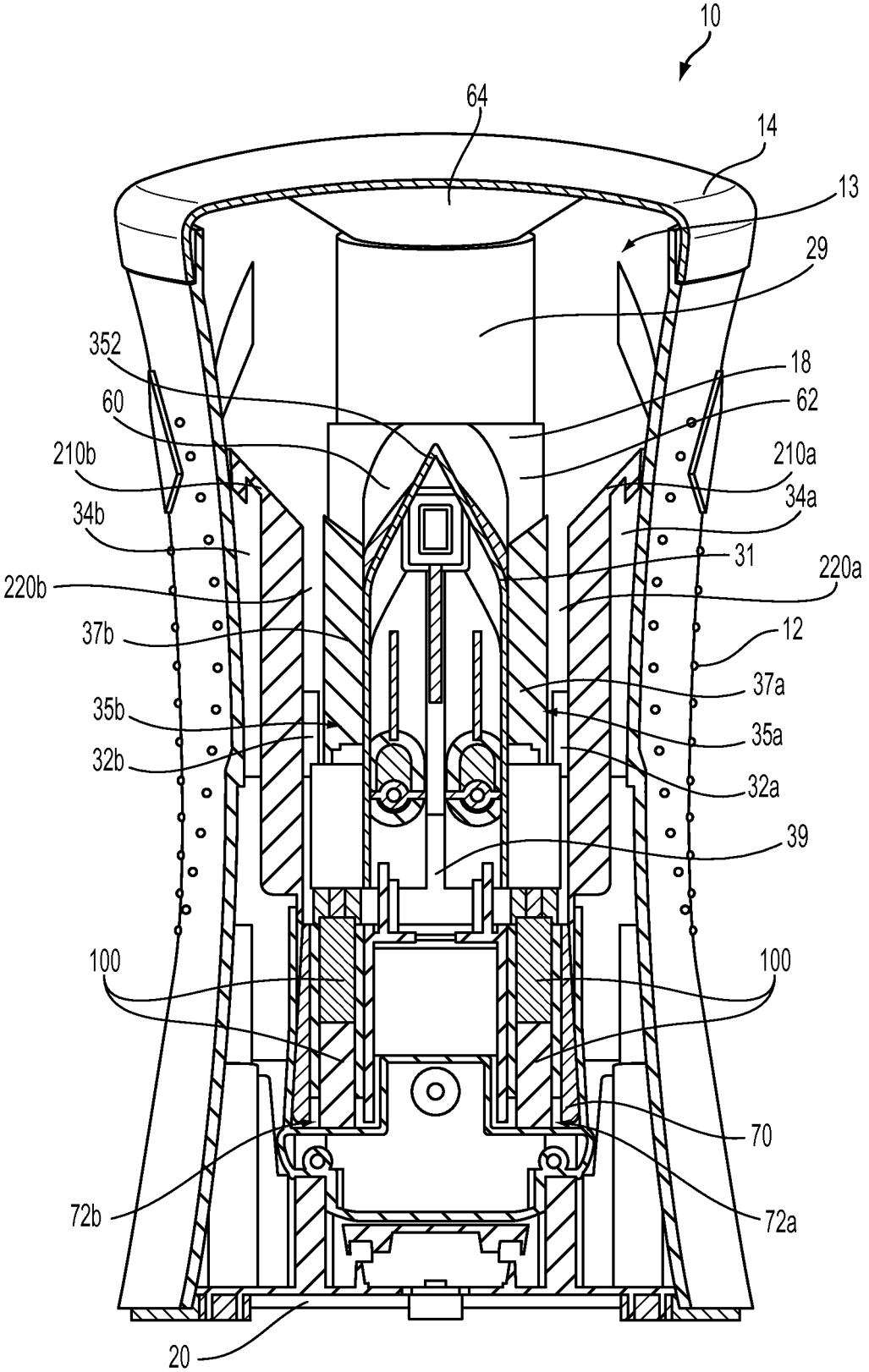
FIG. 7 is cross-section view of the tile dispenser in accordance with some embodiments.

FIG. 1 is a perspective view of a tile dispenser 10 in accordance with various embodiments. FIG. 7 is cross-section view of the tile dispenser 10 in accordance with some embodiments. With reference to FIGS. 1 and 7, the tile dispenser 10 includes a housing 12, a lid 14 that is placeable on the housing 12, a tile positioning system 18 movably disposed within the housing 12, a base element 20 coupled to the housing 12, and a gate element 70 that is movably disposed within the tile dispenser 10.

The housing 12 may be of a suitable shape including, but not limited to, a substantially cylindrical shape, a substantially box shape, a combination thereof, and/or the like. An outer profile of the housing 12 may be shaped other than as described and illustrated, and may also include one or more decorative elements if such is desired.

Figure 2:
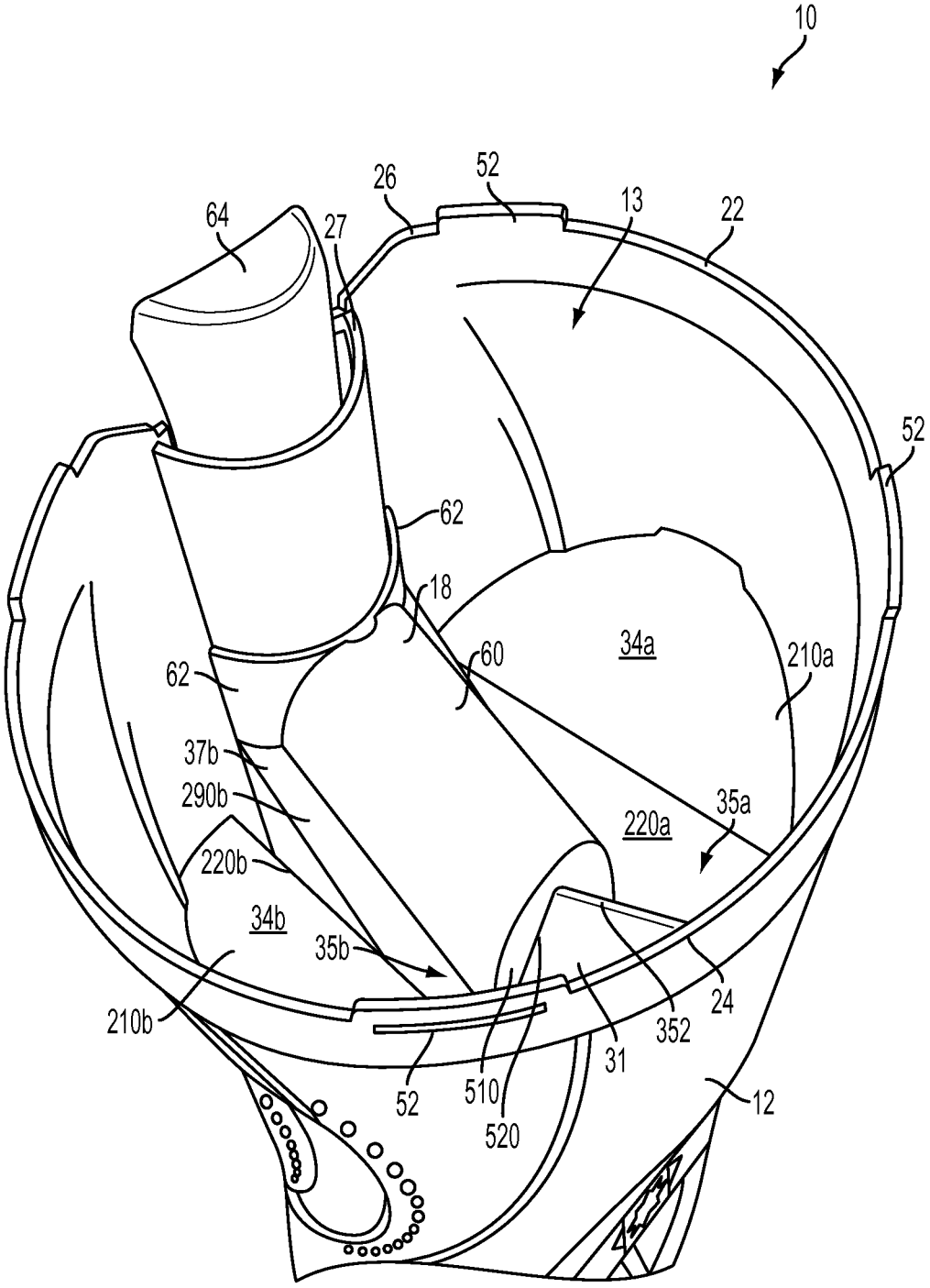
FIG. 2 is a side-top perspective view of the tile dispenser with a lid open and with a positioning system being in an idle state in accordance with some embodiments.
Figure 4:
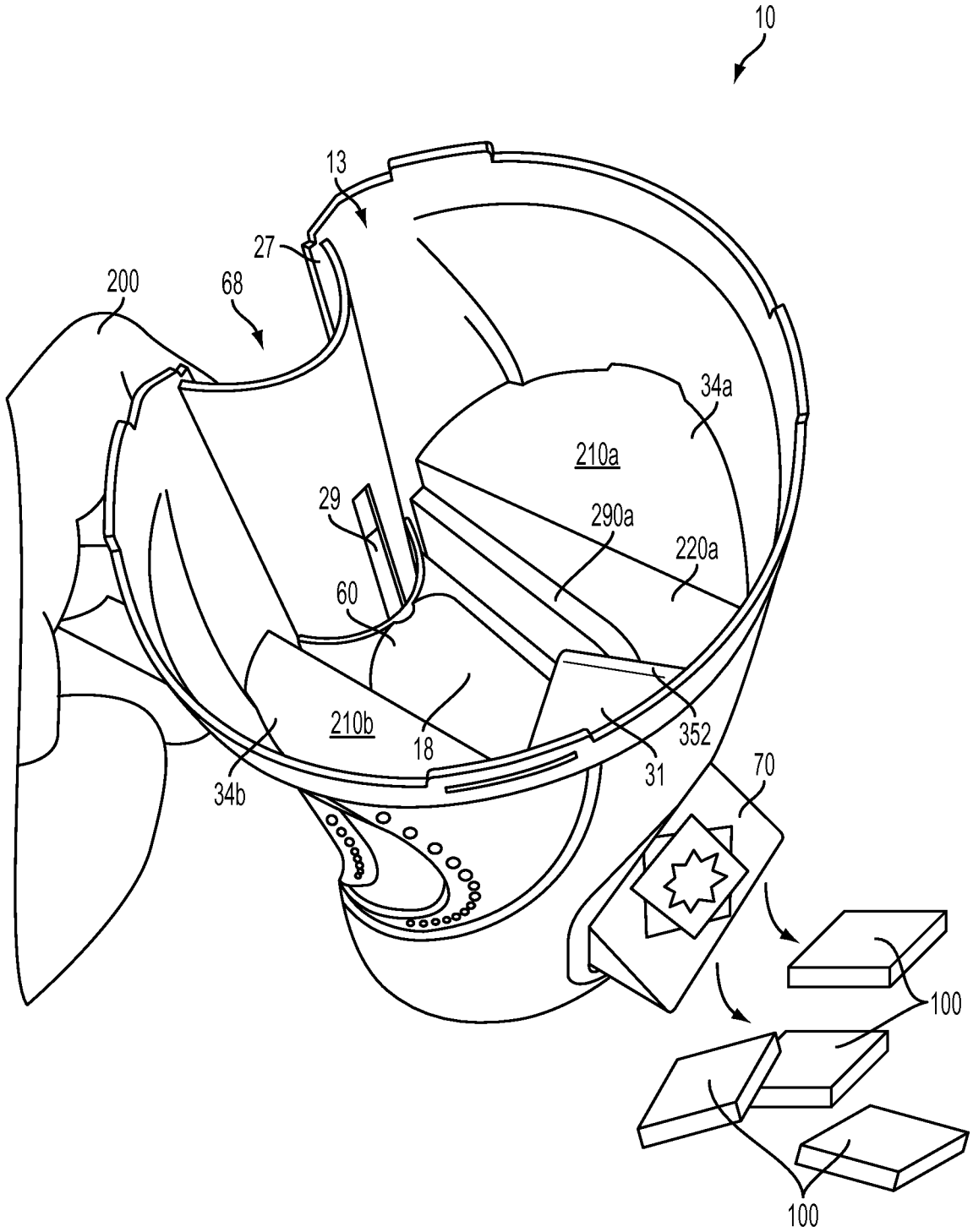
FIG. 4 is a side-top view of the tile dispenser with the lid open and with the positioning system in an activated state in accordance with some embodiments.

FIG. 2 is a side-top perspective view of the tile dispenser 10 in accordance with various embodiments. FIG. 4 is a side-top view of the tile dispenser 10 in accordance with various embodiments. With reference to FIGS. 1, 2, 4, and 7, in various embodiments, the housing 12 includes a tile chamber 13 disposed therein that is configured to accommodate a plurality of tiles, such as game tiles 100, and/or the like. The tile chamber 13 may have an open top 22 when the lid 14 is removed from the tile dispenser, where a perimeter of the open top 22 is defined by top surfaces of a front wall portion 24 and a rear wall portion 26 of the housing 12. The rear wall portion 26 of the housing 12 may have a housing wall recess 27 with a slit 29 (as shown in FIG. 4). A bottom of the housing 12 may be coupled to the base element 20. In a non-limiting example embodiment, the front wall portion 24, the rear wall portion 26, and/or the base element 20 may be integrally joined or molded from a single piece to form the housing 12 and the tile chamber 13 disposed internally therein, and to define the open top 22.

Figure 3:
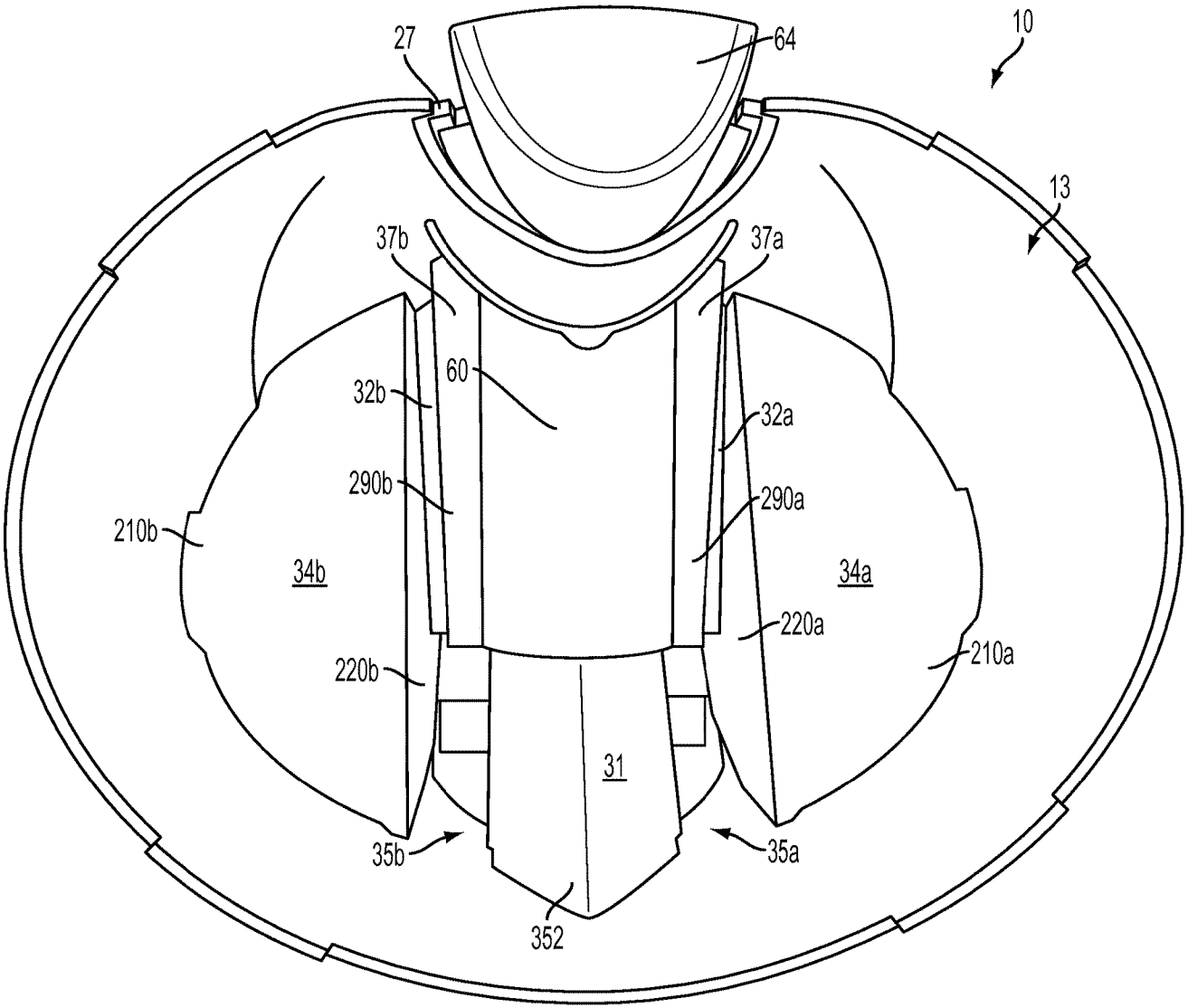
FIG. 3 is a top view of the tile dispenser with the lid open and the positioning system in the idle state in accordance with some embodiments.

FIG. 3 is a top view of the tile dispenser 10 in accordance with various embodiments. As shown in FIGS. 2, 3, 4, and 7, the tile chamber 13 may include at least two side-contoured elements (such as the first side-contoured element 34*a* and the second side-contoured element 34*b*) and a front-contoured element 31. The front-contoured element 31, the first side-contoured element 34*a*, and the second side-contoured element 34*b* may be arranged together to direct and/or position game tiles 100 within the tile chamber 13 downwardly towards recessed areas, such as the first recessed area 35*a* and the second recessed area 35*b* of the tile chamber 13. In some embodiments, the first recessed area 35*a* and the second recessed area 35*b* may be positioned along opposed sides of the front-contoured element 31. The tile chamber 13 may further include base sections, such as a first base section 37*a* and a second base section 37*b* that may be positioned adjacent to respective side-contoured elements 34*a*, 34*b*.

Figure 5:
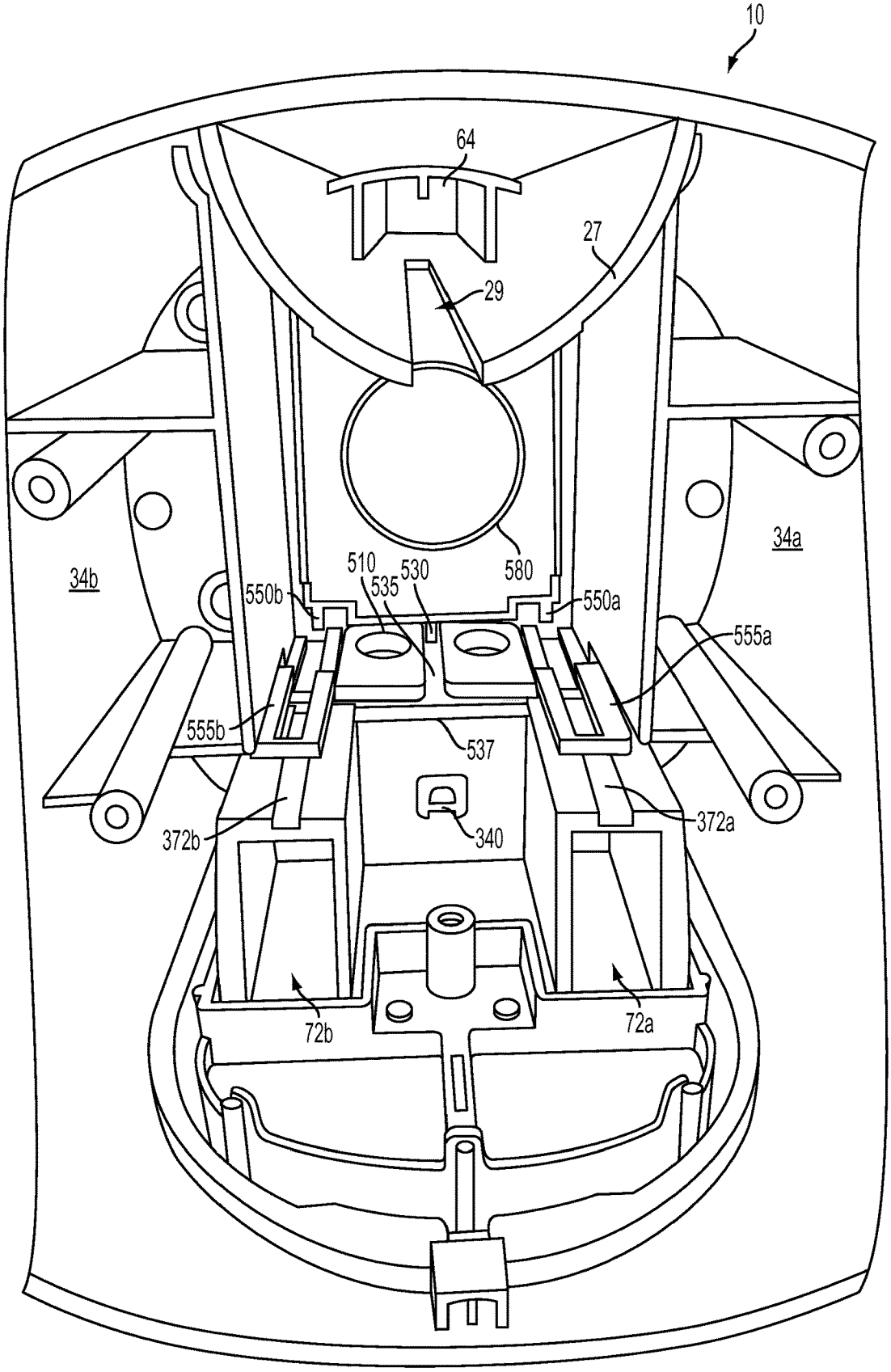
FIG. 5 is bottom view of the tile dispenser with a bottom cover removed in accordance with some embodiments.

In various embodiments, the width of each of the first base section 37*a* and the second base section 37*b* may be about the thickness of a game tile 100. Each of the first base section 37*a* and the second base section 37*b* may extend from an inside wall surface of the rear wall portion 26 of the housing 12 to respective recessed areas 35*a*, 35*b*. The base sections 37*a*, 37*b* may have a downwardly directed angle of departure running from the rear wall portion 26 to the respective recessed areas 35*a*, 35*b* to thereby facilitate movement of the game tiles 100 within the tile chamber 13 toward the recessed areas 35*a*, 35*b*. FIG. 5 is bottom view of the tile dispenser 10 in accordance with various embodiments. With reference to FIGS. 1, 2, 3, 5, and 7, the recessed areas 35*a*, 35*b* may lead to dispenser exit channels, such as a first exit channel 72*a* and a second exit channel 72*b* of the gate element 70 as further described below. In various embodiments, the contoured elements, such as the first side-contoured element 34*a*, the second side-contoured element 34*b*, and the front-contoured element 31 have angled or slanted surfaces, which direct and position the game tiles 100 into respective recessed areas 35*a*, 35*b* associated with the tile chamber 13 (e.g., by gravity, a mechanical push/pull action, a combination thereof, and/or the like).

The lid 14 is connected to cover the open top 22 of the tile chamber 13 and is movable between an open position and a closed position. FIGS. 1 and 7 show the lid 14 in a closed position, while FIGS. 2, 3, and 4 show example when the lid 14 (refer to FIG. 1) is in an open position. With reference to FIGS. 1 and 2, the lid 14 may rest on the open top 22 of the housing 12 to close the tile chamber 13. The lid 14 may be defined by a lid front wall 36, a lid rear wall 38, and a lid top 44. The lid rear wall 38 may have a lid recess 40 to accommodate a push member 64. The lid 14 may include various connecting members that may serve to removably attach the lid 14 to the housing 12. In particular embodiments, the lid rear wall 38 may include lid hinge connection elements (not shown) connected with respective hinge connection elements (not shown) on the housing rear wall 26 by hinge pins (not shown). Each of these respective hinge elements are useable to pivotally connect the lid 14 to the housing 12.

In various embodiments, to prevent an opening of the lid 14 during use, at least one latch (not shown) may also be included on the tile dispenser 10. The latch may be of any suitable type and in any suitable configuration. In some embodiments, the latch may include a male latch element positioned on the front wall portion 24 of the housing 12 and a female latch element positioned on the lid front wall 36. In further embodiments, additional latch elements may be positioned on the front wall portion 24 of the housing 12, the rear wall portion 26 of the housing 12, the lid front wall 36, and/or the lid rear wall 38 for providing improved securing closure for the tile dispenser 10.

In various embodiments, to use the tile dispenser 10, a player may move the lid 14 to an open position and insert a plurality of game tiles 100 into the tile chamber 13. After the plurality of game tiles 100 are inserted into the tile chamber 13, at least one sealing tab 52 that may be located on the front wall portion 24 and/or the rear wall portion 26 of the housing 12 may be detachably engaged with, such as being snapped into, twisted onto, and/or the like, at least one lid tab (not shown) located on the lid front wall 36 and/or the lid rear wall 38. In further or alternative embodiments, the latch elements may mate for closure of the tile dispenser 10 for storage, transportation, and/or the like.

Referring particularly to FIG. 4, the game tiles 100 in accordance with various embodiments that are used with the tile dispenser 10 are shown. The game tiles 100 may include opposed flat side surfaces (defining a thickness of the tile), and four edges (defining a tile length and a width). The opposed edge surfaces may be parallel to one another. In an example embodiment, the game tiles 100 may have edge surfaces defining a square, rectangle, or other suitable shape. Game tiles 100 suitable for use with the tile dispenser 10 may include, but are not limited to, game tiles associated with the SCRABBLE® crossword game.

Although during typical use the lid 14 (refer to FIG. 1) may be in a closed position (e.g., the lid 14 may contact and be secured to the tile housing 12), FIGS. 2-4 show the tile dispenser 10 with the lid 14 open to illustrate the operation of the tile positioning system 18. In various embodiments, the tile positioning system 18 includes a central member 60 disposed within the tile chamber 13 between the first side-contoured element 34*a*, the second side-contoured element

34*b*, a vertically sliding member 62 adjacent the central member 60 and connected therewith, and a push member 64 disposed in the housing wall recess 27 and coupled to the sliding member 62 and the central member 60. The central member 60 may be interposed between an inside surface of the wall recess 27 and the front-contoured element 31.

FIG. 4 shows an operational state of the tile dispenser 10 when a downward force 68 has been applied to the push member 64 (refer to FIG. 2) by a user 200 to trigger a push-action mechanism to dispense the game tiles 100. With reference to FIGS. 2, 3, and 4, the sliding member 62 and the central member 60 may be integrally connected such that when the push member 64 is activated, such as by being pushed in a downward direction, the sliding member 62 and the central member 60 simultaneously move downwardly in response. These elements may also be coupled to a spring element (not shown), which operates to cause a return of the push member 64, the central member 60, and the sliding member 62 to an initial upwardly disposed position relative to the housing 12 when the user 200 no longer applies the downward force 68. In an example embodiment, the push member 64 is connected with the central member 60 via a connection element extending through the slit 29 in the housing wall recess 27.

When the tile positioning system 18 is moved downwardly, at least one game tile 100 may be moved, such as by gravity, into at least one of the first recessed area 35*a* and the second recessed area 35*b* of the tile chamber 13. In some embodiments, the tile dispenser 10 may be configured to dispense four game tiles 100 during each dispensing operation (e.g., two game tiles 100 may be moved into each of the respective recessed areas 35*a*, 35*b* of the tile chamber 13. A continued downward force 68 applied by the user 200 to the push member 64 may also act to activate the gate element 70 to dispense a predetermined number of the game tiles 100 from the housing 12 via the exit channels 72*a*, 72*b* (refer to FIG. 5) of the gate element 70. In some embodiments, the tile dispenser 10 is configured to dispense more than one of the game tiles 100 during a dispensing operation, such as dispensing 2, 3, 4, 5, 6, 7, or more of the game tiles 100 during a dispensing operation.

Figure 6A:
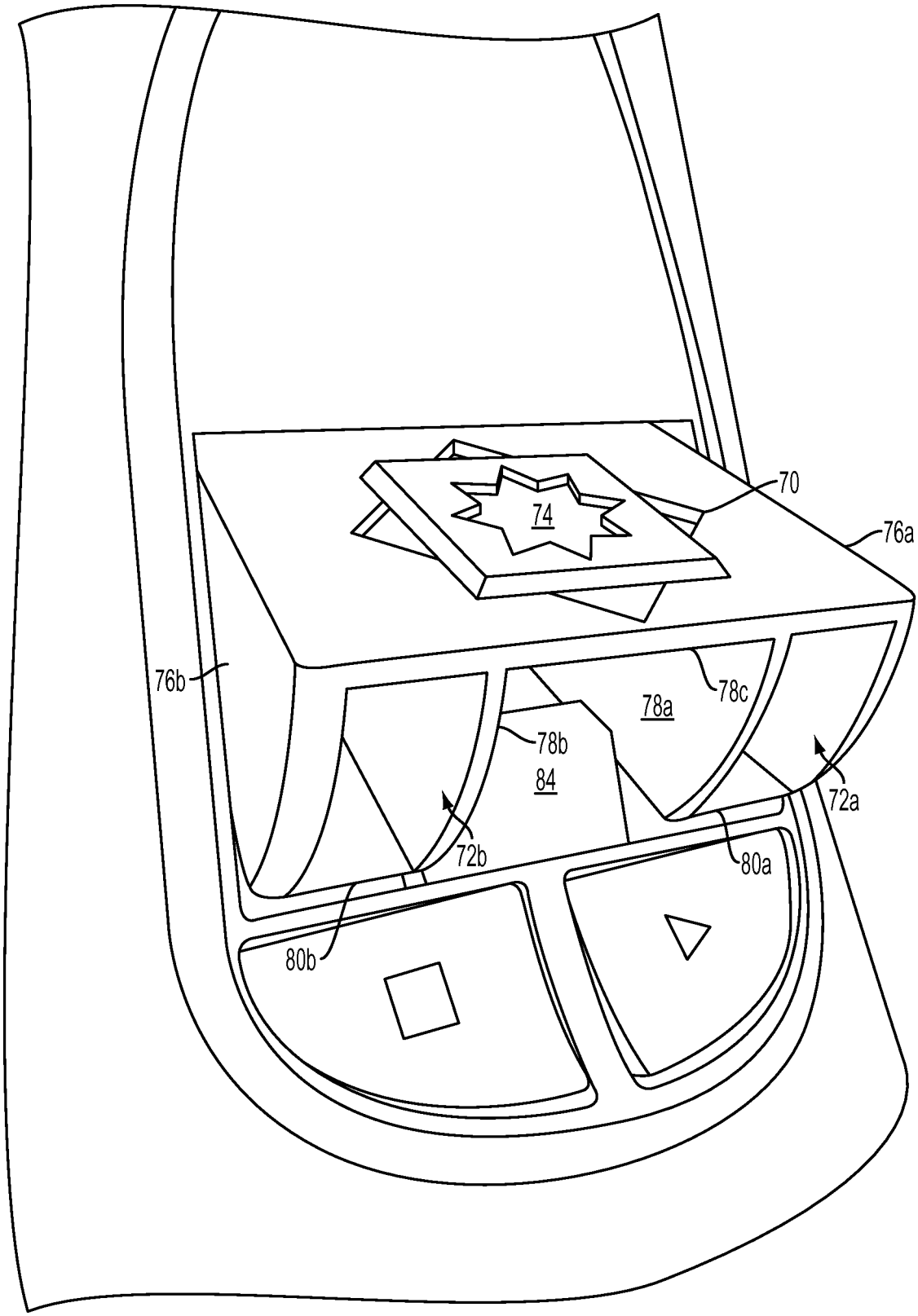
FIG. 6A is a side-bottom view of a gate element of the tile dispenser when the gate element is in an open position in accordance with some embodiments.
Figure 6B:
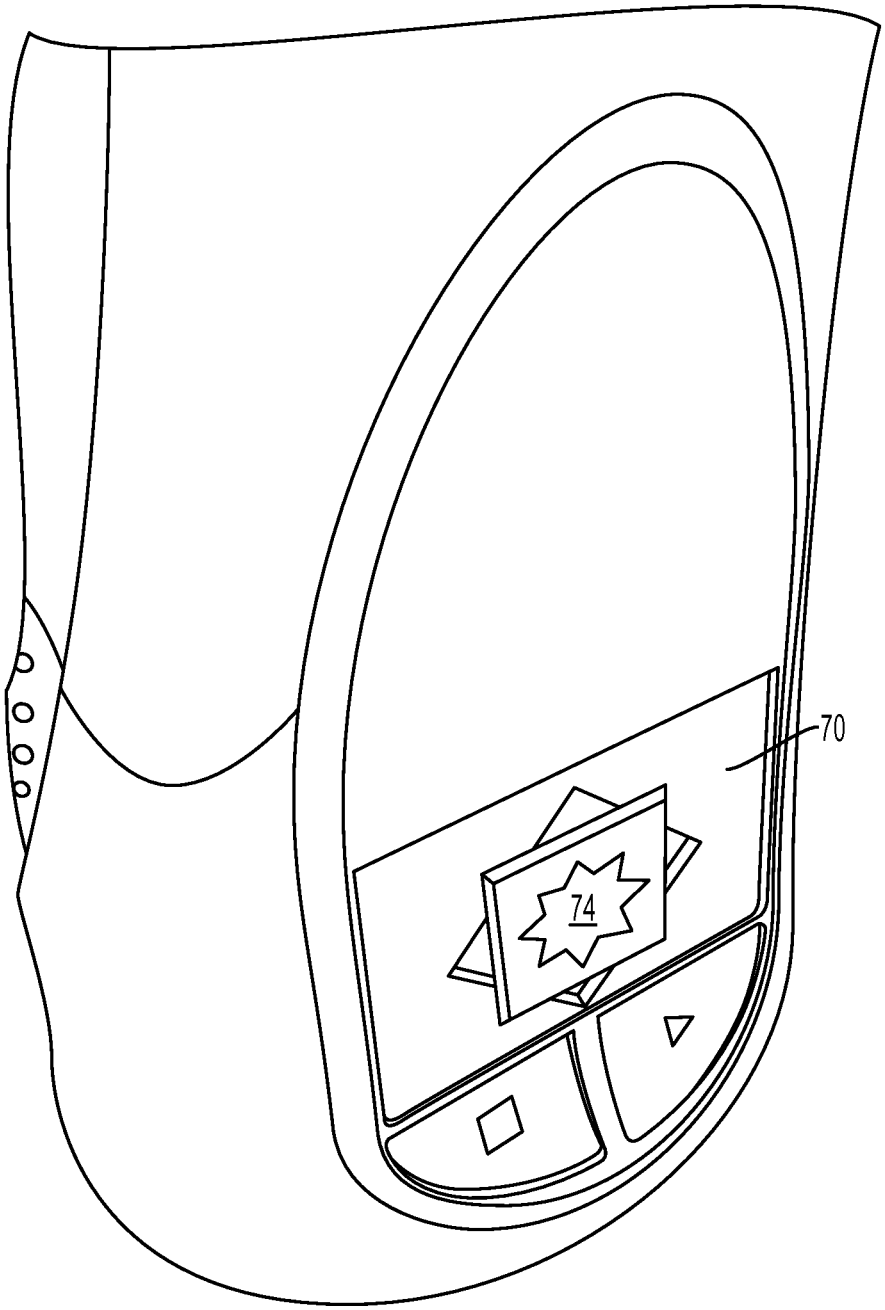
FIG. 6B is a side-bottom view of the gate element of the tile dispenser when the gate element is in an closed position in accordance with some embodiments.

FIG. 6A is a side-bottom view of the gate element 70 of the tile dispenser 10 (refer to FIG. 1) in accordance with various embodiments when the gate element 70 is in the open position. In some embodiments, the gate element 70 includes a gate front wall 74, a first gate side wall 76*a*, a second gate side wall 76*b*, a first gate interior wall 78*a*, a second gate interior wall 78*b*, a third gate interior wall 78*c*, a first gate rear wall 80*a*, and a second gate rear wall 80*b*. Together, these walls form the gate element 70 with the first exit channel 72*a* and the second exit channel 72*b*. FIG. 6B is a side-bottom view of the gate element 70 in accordance with various embodiments when the gate element 70 is in the closed position and shows the gate front wall 74. With reference to FIGS. 1, 3, 4, 6A and 6B, the exit channels 72*a*, 72*b* of the gate element 70 may communicate with the respective recessed areas 35*a*, 35*b* of the tile chamber 13. In various elements, the gate element 70 is connected to a base member 84 that is in an opening in a side of the housing 12. The gate element 70 may be positioned near a bottom of the housing 12. The gate element 70 may be pivotally connected with the housing 12 such that in an initial gate position, such as a closed position, the recessed areas 35*a*, 35*b* of the tile chamber 13 are aligned with the exit channels 72*a*, 72*b* of the gate element 70. In this initial closed position, game tiles 100 in the tile chamber 13 that move into the recessed areas 35*a*, 35*b* may enter the respective exit channels 72*a*, 72*b* such that the game tiles 100 are loaded into the gate element 70 for dispensing.

The downward force 68 applied to the tile positioning system 18 acts both to further cause any tiles in the tile chamber 13 that are not already in the recessed areas 35*a*, 35*b*, to move toward the recessed areas 35*a*, 35*b*. Tiles from the recessed areas 35*a*, 35*b* are loaded into the respective exit channels 72*a*, 72*b* of the gate element 70. The downward force 68 applied to the push member 64 causes the gate element 70 to move relative to the housing 12 to an open position to dispense the game tiles 100 from the exit channels 72*a*, 72*b*. In various embodiments, as the tile positioning system 18 is depressed within the tile chamber 13, being operatively connected with the gate element 70 causes the gate element 70 to pivot relative to the housing 12 such that a bottom portion of the gate element 70 extends outwardly away from the housing 12 while a pivot portion of the gate element 70 remains rotatably coupled to the housing 12. In some embodiments, the positioning system 18 is connected with the gate element 70 via a connecting element that extends from the central member 60 to the front-contoured member 31 through a slit 39 (refer to FIG. 7) in the front-contoured member 31. As the bottom portion of the gate element 70 is moved outwardly with respect to the housing 12, a sufficient portion of the exit channels 72*a*, 72*b* may be moved away from a surface of the housing 12 so as to become exposed and uncovered. Accordingly, the game tiles 100 loaded therein may then be dispensed from the exit channels 72*a*, 72*b* and away from the housing 12.

In some embodiments, the tile positioning system 18 is configured to be depressed within the tile chamber 13 for a defined depth before activating the gate element 70 to release the game tiles 100 disposed in the exit channels 72*a*, 72*b*. This operates to provide a desired degree of tile positioning to ensure tile loading before the gate element 70 is actuated. The positioning system 18 may be connected with the gate element 70 by a cammed connection (e.g., provided by contact made between two opposed registering elements) or by any other suitable types of connection mechanism. In a non-limiting example, the positioning system 18 may be depressed about half the depth of the housing 12 or more in a downward movement to activate the gate element 70. The gate element 70 may include a spring element 340 (refer to FIG. 5) or other suitable mechanism connected thereto for returning the gate element 70 to a closed position for further loading after dispensing the game tiles 100. The base member 84 operates to limit a movement of the gate element 70 to a desired loading position within the dispenser housing 12. The gate element 70 may be returned to a closed position after game tiles 100 have been dispensed from the gate element 70 away from the housing 12. In various embodiments, the gate element 70 is partially contained within and supported by the housing 12.

Referring again to FIG. 1, the tile dispenser 10 in accordance with an embodiment includes the lid 14, the housing 12, the gate element 70, and the push member 64. The lid 14 may seal an upper opening of the housing 12 when the tile dispenser 10 is in an upright orientation. The lid 14 may be detachably coupled to the housing 12 (e.g., to the front wall portion 24 of the housing 12). The lid 14 may include a lid recess 40 configured to receive at least a portion of the push member 64. The push member 64 may also include a portion located in the wall recess 27 of the housing 12 (e.g., as illustrated in FIG. 2). The lid 14 may include the lid front wall 36 and the lid rear wall 38 operatively and detachably coupled to the housing 12.

The gate element 70 may be in the open position, the closed position, or an intermediate state that is between the open position and the closed position. In some embodiments, the game tiles 100 may be dispensed when the gate element 70 is in the open position. Games tiles 100 may be loaded into gate element 70 when the gate element 70 is in the closed position.

With reference to FIGS. 1, 2, 3, 4, 5, and 7 when the lid 14 is removed, the game tiles 100 may be placed into the tile chamber 13 that is defined by portions of the inner walls of the housing 12 (e.g., the front wall portion 24 and the rear wall portion 26), the first side-contoured element 34*a*, the second side-contoured element 34*b*, the central member 60, the front contoured element 31, the first base section 37*a* and the second base section 37*b*. By defining the tile chamber 13, the components/elements described may influence the arrangement of the game tiles 100 within the tile chamber 13, thus influencing the randomizing and dispensing of the game tiles 100.

In various embodiments, the first side-contoured element 34*a* and the second side-contoured element 34*b* are mirrored components arranged within the housing 12 that define a portion of the tile chamber 13. Each of the side-contoured elements 34*a*, 34*b* may include a frontal surface, a side surface, and a side element. For example, the first side-contoured element 34*a* includes a frontal surface 210*a*, a side surface 220*a*, and a side element 32*a*. The second side-contoured element 34*b* includes a frontal surface 210*b*, a side surface 220*b*, and a side element 32*b*. In some embodiments, the side-contoured elements 34*a*, 34*b* are each secured or otherwise coupled to an inner wall of the housing 12. For example, the first side-contoured element 34*a* may be secured to a side of the housing 12 while the second side-contoured element 34*b* may be secured to an opposite side of the dispenser housing 12. At least a portion of the front contoured element 31, the central member 60, the first recessed area 35*a*, the second recessed area 35*b*, the first base section 37*a*, and the second base section 37*b* may be located between the first side-contoured element 34*a* and the second side-contoured element 34*a*.

Each of the frontal surfaces 210*a*, 210*b* may contact a portion of the inner wall of the housing 12 and form an angle greater than 90-degrees with respect to the inner wall. Each of the frontal surfaces 210*a*, 210*b* may substantially face the lid 14 when the lid 14 is coupled to the housing 12. In other words, the frontal surfaces 210*a*, 210*b* may be arranged to be slanted/sloped toward a center of the housing 12 where the recessed areas 35*a*, 35*b* may be in the downward direction when the tile dispenser 10 is in an upright position.

In various embodiments, the side-contoured elements 34*a*, 34*b* are secured to the dispenser housing 12 such that they remain stationary when the push member 64 is depressed by a user. The frontal surfaces 210*a*, 210*b* may be configured to allow the game tiles 100 to slide in a downward direction toward the recessed areas 35*a*, 35*b* when the game tiles 100 are contained within the tile chamber 13. In addition, the slanted surfaces of the frontal surfaces 210*a*, 210*b* may also allow for supporting or holding any of the game tiles 100 that overflow from the recessed areas 35*a*, 35*b*. The frontal surfaces 210*a*, 210*b* may allow the overflowing game tiles 100 to reach the recessed areas 35*a*, 35*b* once the game tiles 100 loaded into the gate element 70 are dispensed (e.g., following depression of the push member 64 and the opening of the gate element 70).

The side surfaces 220*a*, 220*b* may be surfaces bordering the respective frontal surfaces 210*a*, 210*b*. The side surfaces 220*a*, 220*b* may face the central member 60 and the front contoured element 31. The side surfaces 220*a*, 220*b* may define the recessed areas 35*a*, 35*b*. The side surfaces 220*a*, 220*b* may guide the game tiles 100 to respective recessed areas 35*a*, 35*b* and/or the gate element 70. At least a portion of the side surfaces 220*a*, 220*b* may contact or be in close proximity with the gate element 70 to ensure that the game tiles 100 are received by the gate element 70.

In various embodiments, the side elements 32*a*, 32*b* include surfaces protruding from and parallel to the respective side surfaces 220*a*, 220*b*. The thickness of each of the side elements 32*a*, 32*b* may be less than a thickness of the game tiles 100. The side elements 32*a*, 32*b* may face each other and define a space for receiving the central member 60. The central member 60 may be located between the side elements 32*a*, 32*b*. Each of the side elements 32*a*, 32*b* may be in sliding contact with or close to a respective side of the central member 60. In various embodiments, the side elements 32*a*, 32*b* remain stationary when the push member 64 is depressed.

The central element 60 may comprise a cylindrical-like (or other suitable shape) component defining a ridge. The central element 60 may be located between the side-contoured elements 34*a*, 34*b*. In various embodiments, a ridge of the central element 60 faces the lid 14 when the lid 14 is closed. The ridge may be of any suitable shape, including a sharp ridge, a rounded/cylindrical ridge (as shown), a rectangular ridge, and/or the like.

A first end of the central element 60 may be connected to or integrated with the sliding member 62. The sliding member 62 may be an elliptical surface curving toward the center of the housing 12 conforming to the shape of the wall recess 27. The sliding member 62 may be in sliding contact with the wall recess 27. In some embodiments, the wall recess 27 may be between the push member 64 and the central member 60. The push member 64 may be connected or otherwise operatively coupled to the sliding member 62 through the slit 29 (refer to FIG. 4). The slit 29 may be a thin rectangular (or other suitable shaped) slit on the wall recess 27. The slit 29 extends in a vertical direction parallel to a longitudinal axis of the housing 12.

A second end (an end opposite to the first end) of the central element 60 may be a flat surface 510 extending parallel to the longitudinal dimension of the housing 12. The flat surface 510 may be in sliding contact with (or in close proximity to) a sliding side surface 520 of the front contoured element 31. The flat surface 510 of the central element 60 may include at least one gate engaging mechanism (e.g., an engaging protrusion 530 as illustrated in FIG. 5) for moving the gate element 70 from the closed position to the open position. For example, the front contoured element 31 may include at least one guiding recess 535 (and/or slit) that receives the engaging protrusion 530. The engaging protrusion 530 may be moved in the downward direction parallel to the longitudinal axis toward the gate element 70 as a part of the central element 60 when the push member 64 is depressed. The engaging protrusion 530 may be guided by the guiding recess 535 downward to reach an engaging portion 537 of the gate element 70.

In various embodiments the gate element 70 is hinged or otherwise rotatably coupled to the housing 12 (or another component connected to the housing 12), and is configured such that the engaging protrusion 530 contacting the engaging portion 537 of the gate element 70 and pushing the engaging portion 537 (as the engaging protrusion is moving further downward due to further depression of the push member 64) causes the gate element 70 to be moved to the open position.

In some embodiments, the base sections 37*a*, 37*b* extend from the central member 60 toward the side surfaces 220*a*, 220*b*. Each of the base sections 37*a*, 37*b* may include side surfaces facing a respective one of the side surfaces 220*a*, 220*b* of the side-contoured elements 34*a*, 34*b*. Each of the base sections 37*a*, 37*b* may include a upper surface (e.g., the first upper surface 290*a*, the second upper surface 290*b*, and/or the like). The thickness of each of the upper surfaces 290*a*, 290*b* may be approximately as thick as the game tiles 100. In various embodiments, the base sections 37*a*, 37*b* are coupled to a portion of the sliding member 62. The upper surfaces 290*a*, 290*b* may slope downward from the sliding member 62 toward the recessed areas 35*a*, 35*b* for guiding the game tiles 100. In some embodiments, when the push member 64 is not depressed (e.g., when the downward force 68 is not applied, the upper surfaces 290*a*, 290*b* may be configured to allow game tiles 100 to slide down the slope of the upper surfaces 290*a*, 290*b* toward the recessed areas 35*a*, 35*b*.

In some embodiments, the base sections 37*a*, 37*b* may each include at least one stabilizing protrusion (e.g., a first stabilizing protrusion 550*a* and the second stabilizing protrusion 550*b*). Each of the at least one stabilizing protrusion may extend from the base sections 37*a*, 37*b* toward the gate element 70 and/or the front contoured element 31. The front contoured element 31 may include at least one stabilizing track and/or slit (e.g., a first stabilizing track 555*a* coupled to the first stabilizing protrusion 550*a*, a second stabilizing track 555*b* coupled to the second stabilizing protrusion 550*b*, and/or the like) for stabilizing the downward and upward movement of the central member 60 (and its associated/integrated components including the upper surfaces 290*a*, 290*b*, base sections 37*a*, 37*b*, the engaging protrusion 530, the sliding member 62, the push member 64, and/or the like). In addition, the gate element 70 may include one or more secondary recesses (e.g., a first secondary recess 372*a*, and a second secondary recess 372*b*) to further stabilize the motion of the central member 60 (and its associated/integrated components). For example, the first stabilizing protrusion 550*a* may be coupled to both of the first stabilizing track 55*a* and the first secondary recess 372*a*.

When the push member 64 is depressed, the push member 64 may move in the downward direction toward the gate element 70. Given the connection/linkage between the sliding member 62 and the push member 64 through the slit 29, the sliding member 62 may be moved in the downward direction together with the push member 64 as a unit. The central member 60 (as well as its subcomponents) is coupled to or integral with the sliding member 62. The push member 64, the sliding member 62, and the central member 60 may all move together along an axis parallel to the longitudinal axis of the dispenser housing 12.

In some embodiments, the front contoured element 31 may include a ridge component 352. The ridge component 352 may be configured to be a triangular prism with a sharp edge pointing toward the lid 14 when the lid 14 is engaged with the housing 12. In some embodiments, the ridge component 352 of the front contoured element 31 may be of a different shape than the ridge portion of the central member 60. The front contoured element 31 may extend toward and/or overlap the gate element 70. As described, the front contoured element 31 may include at least one guiding recess 535 (and/or slit), at least one stabilizing track (e.g., the first stabilizing track 555*a*, the second stabilizing track 555*b*, and/or the like). In various embodiments, the front contour element 31 is secured to the housing 12 and remains stationary when the push member 64 is depressed.

In some embodiments, a retraction module such as a spring module 580 is provided to allow the push member 64, the central member 60, and/or associated/integrated components to be retracted back to an initial position before the push member 64 is depressed. The spring module 580 (spring not shown) may receive a spring of suitable spring strength. The spring module 580 may be located below a bottom surface of the central member 60, such that the spring may be between the spring module 580 and the base element 20.

In various embodiments, the gate element 70 includes a gate retraction mechanism 340 such as a spring system for returning the gate element 70 from the open position to the closed position. In a non-limiting example, one end of at least one spring may be attached or coupled to the gate element 70 while the other end of the at least one spring may be attached or coupled to the inner wall of the housing 12, the front contoured element 31, and/or the like. As the gate element 70 is pushed to the open position (e.g., by the engaging protrusion 530 when the push member 64 is depressed by the downward force 68), the at least one spring may be extended. In response to the push member 64 being released when the downward force 68 is no longer applied, the gate retraction mechanism 340 may be configured to retract the gate element 70 back to the closed position. In particular, the extended spring may retract back to its original unextended state, pulling the gate element 70 with it.

Figure 8:
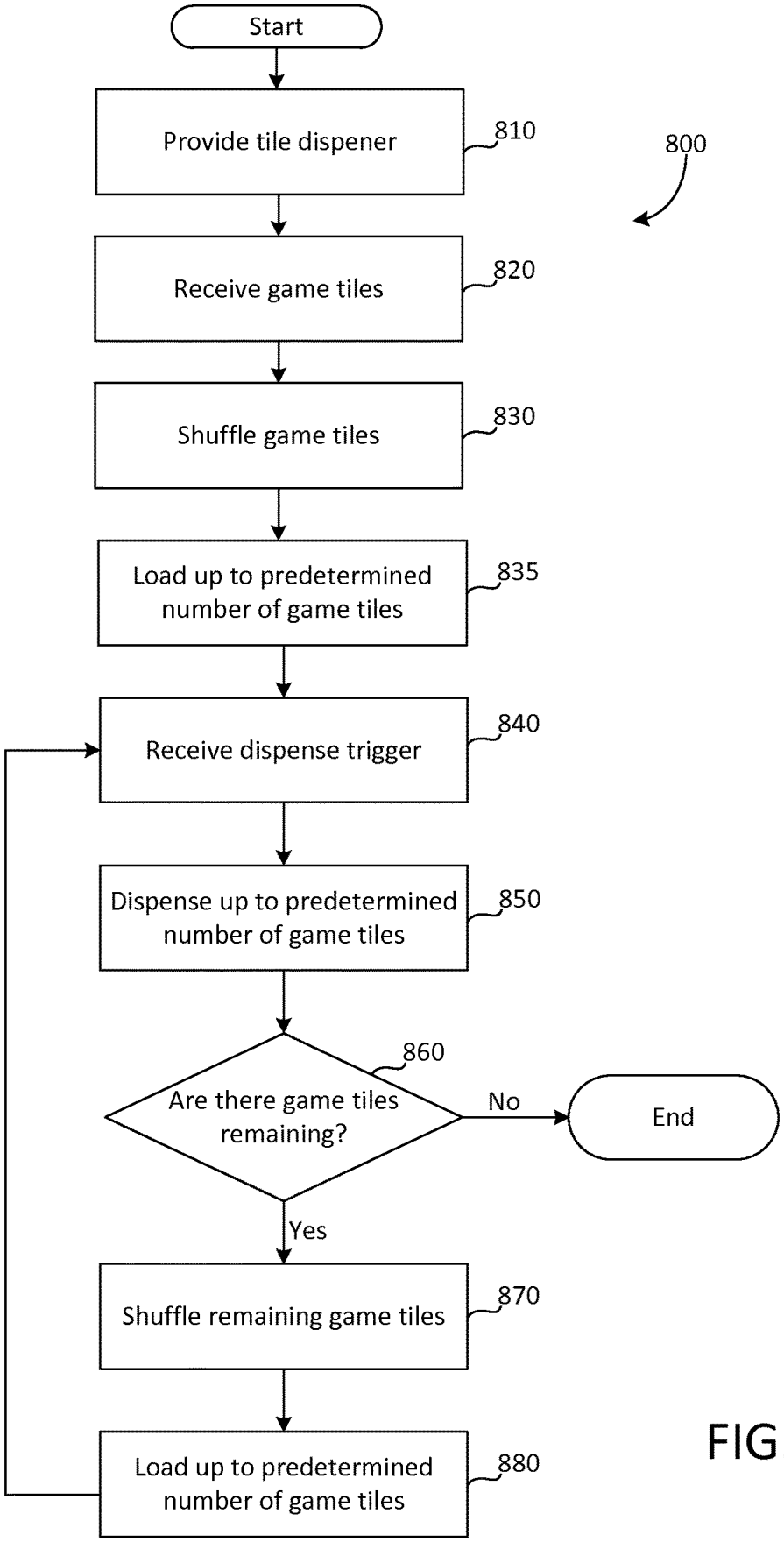
FIG. 8 is a process flowchart illustrating a tile dispensing method in accordance with some embodiments.

FIG. 8 is a flowchart illustrating a tile dispensing method 800 in accordance with an embodiment using a tile dispenser such as, but not limited to, the tile dispenser 10 of FIG. 1. With reference to FIGS. 1, 2, 4, 5, 6A, and 8, at block 810 a tile dispenser such as, but not limited to, the tile dispenser 10 may be provided. Next at block 820, the tile dispenser 10 may be configured to receive the game tiles 100. In some embodiments, the lid 14 may be configured to be removed by the user 200 of the tile dispenser, exposing the open top 22. The game tiles 100 may be loaded into the tile chamber 13.

In some embodiments, the tile chamber 13 is defined by a portion of the housing 12, the central member 60, the side-contoured elements 34*a*, 34*b*, the front contoured element 31, and the recessed areas 35*a*, 35*b*. In some embodiments the tile chamber 13 is defined by a portion of the housing 12, the sliding member 62, the central member 60, the frontal surfaces 210*a*, 210*b*, the side surfaces 220*a*, 220*b*, the side elements 32*a*, 32*b*, the base sections 37*a*, 37*b*, the upper surfaces 290*a*, 290*b*, and the front contoured element 31. The tile chamber 13 provides an interior volume for receiving the game tiles 100.

Next at block 830, the games tiles 100 may be shuffled or otherwise randomized by mixing in the tile chamber 13. In some embodiments, the tile dispenser 10 may randomize the game tiles 100 as the game tiles 100 are being received through the open top 22. In particular, given the arrangement of the surfaces (e.g., the frontal surfaces 210*a*, 210*b*, the side surfaces 220*a*, 220*b*, the side elements 32*a*, 32*b*, the ridge portion of the central member 60, the upper surfaces 290*a*, 290*b*, the ridge component 352, and/or the like) as described, the game tiles 100 that have been received into the tile chamber 13 prior to others may not always be the first ones dispensed.

In further embodiments, the tile dispenser 10 may be configured to shuffle/randomize the game tiles 100 in the tile chamber 13 due to user action. In some embodiments, when all game tiles 100 are received by the interior volume of the tile chamber 13, the lid 14 may be placed on the open top 22 to seal the tile chamber 13. The tile chamber 13 may provide the interior volume configured for mixing/randomizing of the game tiles 100 in response to physical motion or orientation of the tile dispenser 10. For example, after the lid 14 has been engaged with the housing 12, the user may shake the tile dispenser 10 as a whole. Given that the game tiles 100 do not occupy the entirety of the interior volume of the tile chamber 13, extra space within the interior volume is provided for the game tiles 100 contained therein to mix due to the shaking or the disorienting of the tile dispenser 10. The arrangement of the components of the tile chamber 13 may further provide additional randomness into the randomization process. In other words, in some embodiments the interior volume of the tile chamber 13 provides surfaces such that the game tiles 100 contained therein may be free to mix. Accordingly, shuffling of the game tiles 100 can be achieved. In various embodiments, the game tiles 100 within the recessed areas 35*a*, 35*b* may be received by the gate element 70 into the exit channels 72*a*, 72*b* as pulled by gravity when the gate element is in the closed position.

Next at block 835, up to the predetermined number of the game tiles 100 may be loaded into the exit channels 72*a*, 72*b*. In some embodiments, the group of game tiles 100 to be dispensed is loaded (e.g., by gravity) from the recessed areas 35*a*, 35*b* following the mixing/randomization as described with respect to block 830. When the number of game tiles 100 is greater to or equal to the predetermined number, the predetermined number of game tiles 100 may be loaded into the exit channels 72*a*, 72*b*. On the other hand, when the number of game tiles 100 is less than the predetermined number, all the remaining game tiles 100 may be loaded into the exit channels 72*a*, 72*b*. Next at block 840, the tile dispenser 10 receives a dispense trigger. In various embodiments, the dispense trigger is the downward force 68 being exerted on the push element 64 to drive the push element 64 and its associated/connected components (e.g., the central member 60) in the downward direction.

Next at block 850, the tile dispenser 10 dispenses up to a predetermined number of game tiles 100. In some embodiments, the predetermined number of game tiles 100 may be proportional to the length of the exit channels 72*a*, 72*b* and/or the length of recessed areas 35*a*, 35*b*. In a non-limiting example, the exit channels 72*a*, 72*b* may be configured to receive two game tiles 100 each (with the predetermined number of game tiles 100 to be four). Each of the exit channels 72*a*, 72*b* may be associated with a length approximately twice the width of the game tiles 100, where each game tile may be of the same width.

When the gate element 70 is opened, the gate element 70 may rotate around a hinge outward from the dispenser housing 12. Thus, additional game tiles 100 not in the exit channels 72*a*, 72*b* (e.g., gamed tiles 100 in the recessed areas 35*a*, 35*b*) may not be dispensed. This is because the communication between the exit channels 72*a*, 72*b* and the recessed areas 35*a*, 35*b* is broken as the gate element 70 is opened. For example, the communication area may be too small to allow additional game tiles 100 to move from the recessed areas 35*a*, 35*b* to the exit channels 72*a*, 72*b* when the gate element 70 is being opened. The communication is restored once the gate element 70 returns to the closed position. Accordingly, in various embodiments, only the game tiles 100 within the exit channels 72*a*, 72*b* at the time that the gate element 70 is opened may be dispensed. When the number of tiles remaining in the tile dispenser 10 is below the predetermined number of game tiles 100, the dispenser exit channels 72*a*, 72*b* may not be filled up completely. In that case, the remaining number of game tiles 100 may be dispensed.

As described, when the push member 64 is depressed by the downward force 68, the central member 60 may be moved in the downward direction by virtue of being coupled to the push member 64 through the slit 29. The central member 60 may include the engaging protrusion 530 being moved in the downward direction as a part of the central element 60 when the push member 64 is depressed. The engaging protrusion 530 may contact the engaging portion 537 of the gate element 70 and push the engaging portion 537 as the engaging protrusion 530 moves further downward due to further depression of the push member 64. In turn, the gate element 70 may be opened (rotated around the hinge) accordingly and the game tiles 100 may be dispensed.

Next at block 860, it is determined whether there are game tiles 100 remaining in the interior volume of the tile chamber 13. In some embodiments, when there are no game tiles 100 remaining (860: NO), the process ends. In some embodiments, this means that when the user 200 exerts the downward force 68 again on the push element 64, the gate element 70 may open in the manner described but no game tiles 100 may be dispensed. In other embodiments, an electrical and/or mechanical device may be provided to detect whether there are game tiles 100 remaining.

On the other hand, when there are one or more game tiles 100 remaining (860: YES), the tile dispenser 10 may randomize the remaining game tiles 100 at block 870. In some embodiments, the game tiles 100 contained within the interior volume of the tile chamber 13 may be shuffled when the tile dispenser 10 (as a whole) is physically shaken or disoriented. In some embodiments, the space between the upper surfaces 290*a*, 290*b*, the ridged portion of the central member 60, the surfaces of the side elements 32*a*, 32*b*, and/or the side surfaces 220*a*, 220*b*) may decrease as the central member 60 and the upper surfaces 290*a*, 290*b* move in the upward direction as the push member 64 ceases to be depressed (due to the spring force as described). As the upper surfaces 290*a*, 290*b* move up, game tiles 100 may be pushed outward and mixed/shuffled.

Next at block 880, up to the predetermined number of the game tiles 100 may be loaded into the exit channels 72*a*, 72*b*. In some embodiments, the next group of game tiles 100 to be dispensed is loaded (e.g., by gravity) from the recessed areas 35*a*, 35*b* following the mixing/randomization as described with respect to block 870. When the remaining number of game tiles 100 is greater to or equal to the predetermined number, the predetermined number of game tiles 100 may be loaded into the exit channels 72*a*, 72*b*. On the other hand, when the remaining number of game tiles 100 is less than the predetermined number, all the remaining game tiles 100 may be loaded into the exit channels 72*a*, 72*b*. Next, the process returns to block 840, where the dispense trigger may be received as described.

As described above, in various embodiments the tile dispenser 10 includes the tile chamber 13 in which tiles are shuffleable and the gate element 70 that is moveable between a closed position in which the gate element 70 is loadable with one or more tiles coming from the tile chamber 13 and an open position for dispensing any tiles that have been loaded into the gate element 70. In various embodiments, at least a portion of the gate element 70 is located under the tile chamber 13. In some embodiments, at least a portion of a bottom of the tile chamber 13 is a surface that slopes downward (such as the frontal surface 210*a* and/or frontal surface 210*b*) from a wall of the tile chamber 13.

In various embodiments, at least a portion of a wall of the tile chamber 13 is a portion of an inner wall of the housing 12 and at least a portion of the gate element 70 is located in an opening in a side of the housing 12. In some embodiments, the spring element 340 is connected to the gate element 70 for biasing the gate element 70 toward the closed position. In some embodiments, the push member 64 is configured to interact with the gate element 70 and is moveable from a first position to a second position to cause the gate element 70 to move from the closed position to the open position. In some embodiments, the spring module 580 with a spring biases the push member 64 toward the first position.

In various embodiments, the central member 60 is connected to the push member 64 and is moveable when the push member 64 moves from the first position (as in FIG. 2) to the second position (as in FIG. 4). In some embodiments, at least a portion of a bottom of the tile chamber 13 is a surface of the central member 60 that slopes downward. In some embodiments, the front contoured element 31 is adjacent to the central member 60 and is positioned such that a top of the front contoured element 31 is below a top of the central member 60 when the push member 64 is in the first position and the top of the front contoured element 31 is above the top of the central member 60 when the push member 64 is in the second position.

In various embodiments, the gate element comprises the exit channel 72*a*. In some embodiments, the gate element 70 is configured such that an exit end of the exit channel 72*a* is blocked when the gate element 70 is in the closed position, and the gate element 70 is configured such that the exit end of the exit channel 72*a* is open to outside of the tile dispenser 10 when the gate element 70 is in the open position. In various embodiments, the gate element 70 is configured such that there is a path from the tile chamber 13 to the exit channel 72*a* of the gate element 70 when the gate element 70 is in the closed position, and the gate element 70 is configured such that the path from the tile chamber 13 to the exit channel 72*a* of the gate element 70 is severed by the gate element 70 when the gate element 70 is in the open position. In some embodiments, the exit channel 72*a* has a size such that the exit channel 72*a* is loadable with more than one tile when the gate element 70 is in the closed position.

Figure 9:
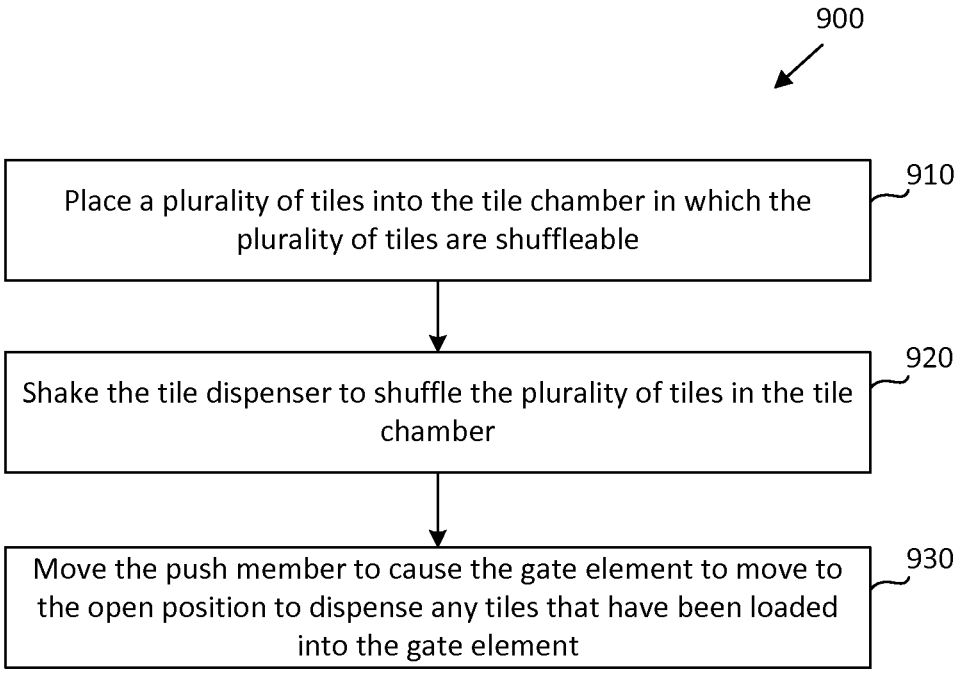
FIG. 9 is a process flowchart illustrating a tile dispensing method in accordance with some embodiments.

FIG. 9 is a flowchart of a method 900 of using the tile dispenser 10 (refer to FIG. 1) in accordance with an embodiment. With reference to FIGS. 1, 2, 4, 5, 6A, and 9, at block 910 a plurality of tiles are placed by a user into the tile chamber 13 in which the plurality of tiles are shuffleable. The method then continues to block 920. In block 920 a user shakes the tile dispenser 10 to shuffle the plurality of tiles in the tile chamber 13. A predetermined number of the plurality of tiles are loaded (e.g., by gravity) into the gate element 70 of the tile dispenser 10 when the gate element 70 is in a closed position. The method then continues to block 930. In block 930, the push member 64 is moved to cause the gate element 70 to move to an open position to dispense any tiles that have been loaded into the gate element 70. In various embodiments, the movement of the push member 64 further causes the central member 60 that is connected to the push member 64 to move to direct tiles from the tile chamber 13 toward the gate element 70. Also, in various embodiments, the gate element 70 is biased toward the closed position, such as by the spring element 340.

Figure 10:
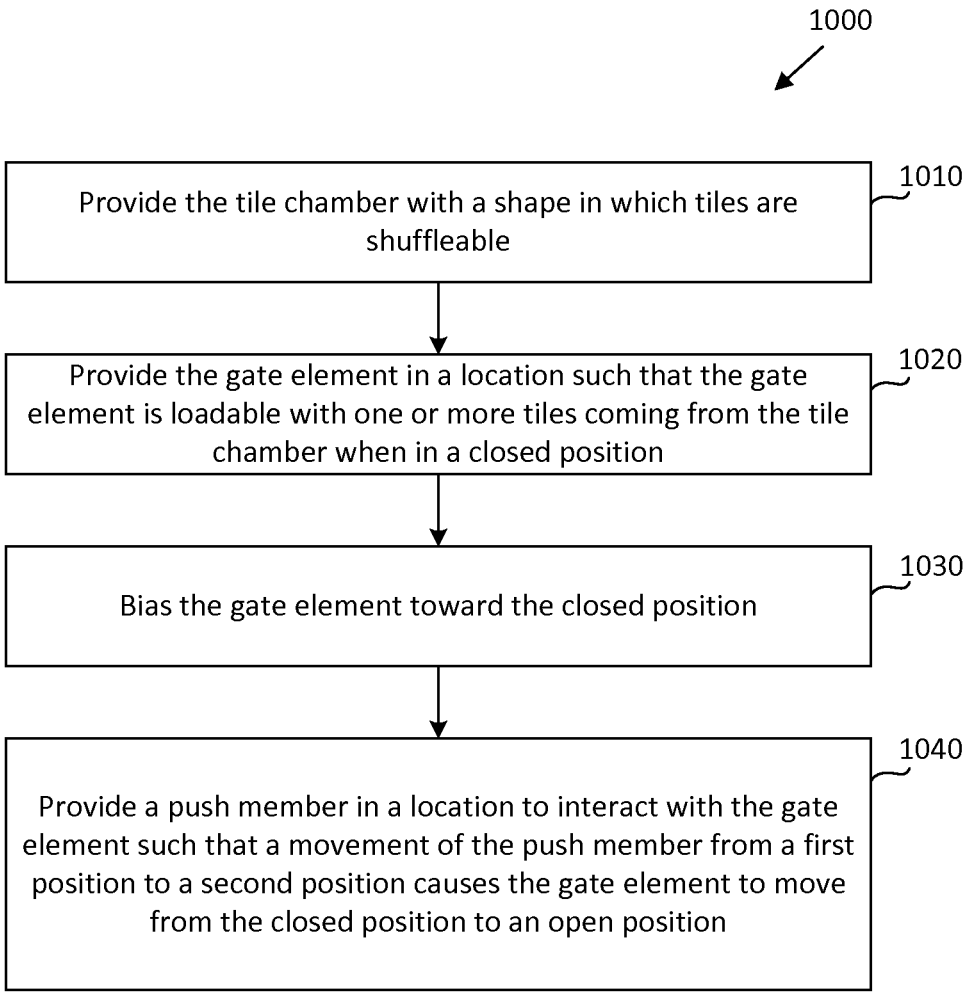
FIG. 10 is a process flowchart illustrating a method of manufacturing a tile dispenser in accordance with some embodiments.

FIG. 10 is a flowchart of a method 1000 of manufacturing the tile dispenser 10 (refer to FIG. 1) in accordance with an embodiment. With reference to FIGS. 1, 2, 4, 5, 6A, and 10, at block 1010 the tile chamber 13 is provided with a shape in which tiles are shuffleable. The method then continues to block 1020. In block 1020, the gate element 70 is provided in a location such that the gate element 70 is loadable with one or more tiles coming from the tile chamber 13 when in a closed position. The method then continues to block 1030. In block 1030, the gate element 70 is biased toward the closed position, such as by attaching the spring element 340 to the gate element 70. The method then continues to block 1040. In block 1040, the push member 64 is provided in a location to interact with the gate element 70 such that a movement of the push member 64 from the first position to the second position causes the gate element 70 to move from the closed position to an open position. In various embodiments, the gate element 70 is shaped such that any tiles that have been loaded into the gate element 70 are dispensable from the gate element 70 when the gate element 70 is in the open position.

Dispensing game tiles automatically or upon initiation by a player can provide several benefits. Depending on the dispensing method used, dispensing game tiles can increase the anticipation and excitement of receiving new tiles and thus of the game. A method and apparatus to mix tiles efficiently can create an increased level of randomization of the tiles, making the tile-based game more enjoyable.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. Various modifications and changes that come within the meaning and range of equivalency of the claims are intended to be within the scope of the invention.

What is claimed is:

1. A tile dispenser, comprising:

a tile chamber in which tiles are shuffleable; and a gate element that is moveable between a closed position in which the gate element is loadable with one or more tiles coming from the tile chamber and an open position for dispensing any tiles that have been loaded into the gate element;

wherein the gate element is configured such that more than one tile is dispensable from the gate element when the gate element is moved from the closed position to the open position;

wherein the gate element has a shape that defines a first exit channel and a second exit channel for dispensing tiles from the gate element; and wherein the first exit channel is separate from the second exit channel.

2. The tile dispenser of claim 1, wherein at least a portion of the gate element is located under the tile chamber.

3. The tile dispenser of claim 1, wherein at least a portion of a bottom of the tile chamber is a surface that slopes downward from a wall of the tile chamber.

4. The tile dispenser of claim 1, wherein at least a portion of a wall of the tile chamber is a portion of an inner wall of a housing of the tile dispenser; and wherein at least a portion of the gate element is located in an opening in a side of the housing.

5. The tile dispenser of claim 1, further comprising:

a spring element connected to the gate element for biasing the gate element toward the closed position.

6. The tile dispenser of claim 1, further comprising:

a push member configured to interact with the gate element and moveable from a first position to a second position to cause the gate element to move from the closed position to the open position.

7. The tile dispenser of claim 6, further comprising:

a spring module for biasing the push member toward the first position.

8. The tile dispenser of claim 6, further comprising:

a central member connected to the push member and moveable when the push member moves from the first position to the second position;

wherein at least a portion of a bottom of the tile chamber is a surface of the central member that slopes downward.

9. The tile dispenser of claim 8, further comprising:

a front contoured element adjacent to the central member and positioned such that a top of the front contoured element is below a top of the central member when the push member is in the first position and the top of the front contoured element is above the top of the central member when the push member is in the second position.

10. The tile dispenser of claim 1, wherein the gate element is configured such that an exit end of the first exit channel is blocked when the gate element is in the closed position; and wherein the gate element is configured such that the exit end of the first exit channel is open to outside of the tile dispenser when the gate element is in the open position.

11. The tile dispenser of claim 10, wherein the gate element is configured such that there is a path from the tile chamber to the first exit channel of the gate element when the gate element is in the closed position; and wherein the gate element is configured such that the path from the tile chamber to the first exit channel of the gate element is severed by the gate element when the gate element is in the open position.

12. The tile dispenser of claim 10, wherein the first exit channel has a size such that the first exit channel is loadable with more than one tile when the gate element is in the closed position.

13. The tile dispenser of claim 1, wherein the first exit channel and the second exit channel each have a size such that at least one tile is loadable into the first exit channel and at least one tile is loadable into the second exit channel.

14. The tile dispenser of claim 1, wherein the first exit channel and the second exit channel each have a size such that more than one tile is loadable into the first exit channel and more than one tile is loadable into the second exit channel.

15. The tile dispenser of claim 1, wherein the gate element is configured such that any tiles that have been loaded into the first exit channel and the second exit channel are dispensed from the gate element when the gate element is moved from the closed position to the open position.

16. The tile dispenser of claim 1, wherein the first exit channel extends from a top of the gate element to a bottom of the gate element; and wherein the second exit channel extends from a top of the gate element to a bottom of the gate element.

17. The tile dispenser of claim 1, wherein the gate element is positioned such that an exit end of the first exit channel and an exit end of the second exit channel are blocked when the gate element is in the closed position, and the exit end of the first exit channel and the exit end of the second exit channel are open to outside of the tile dispenser when the gate element is in the open position.

18. The tile dispenser of claim 1, wherein the shape of the gate element defines the first exit channel and the second exit channel from which tiles are dispensable at a same time when the gate element is in the open position.

19. The tile dispenser of claim 18, wherein the first exit channel extends from a first opening at a top of the gate element to a first opening at a bottom of the gate element; and wherein the second exit channel extends from a second opening at a top of the gate element to a second opening at a bottom of the gate element.

20. The tile dispenser of claim 1, wherein the gate element is configured such that when the gate element is in the closed position the first exit channel is loadable with at least one tile at a same time that the second exit channel is loadable with at least one tile.

* * * * *